US009113524B2

(12) United States Patent
Kurt et al.

(10) Patent No.: US 9,113,524 B2
(45) Date of Patent: Aug. 18, 2015

(54) LED LIGHT SOURCE

(75) Inventors: Ralph Kurt, Eindhoven (NL); Haimin Tao, Eindhoven (NL); Martinus Petrus Creusen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 54 days.

(21) Appl. No.: 14/006,979

(22) PCT Filed: Mar. 19, 2012

(86) PCT No.: PCT/IB2012/051312

§ 371 (c)(1),
(2), (4) Date: Sep. 24, 2013

(87) PCT Pub. No.: WO2012/131530

PCT Pub. Date: Oct. 4, 2012

(65) Prior Publication Data

US 2014/0015430 A1 Jan. 16, 2014

(30) Foreign Application Priority Data

Mar. 31, 2011 (EP) ..... 11160666

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
CPC ..... H05B 37/02; H05B 33/0812; H05B 33/0815; H05B 33/083; H05B 33/0836
USPC ..... 315/185 R, 200 R, 209 R, 291, 307, 308, 315/312
See application file for complete search history.

(56) References Cited

U.S. PATENT DOCUMENTS

| | | | | |
|---|---|---|---|---|
| 7,081,722 | B1 | 7/2006 | Huynh | |
| 8,519,636 | B2 * | 8/2013 | Wen-Kuei | 315/291 |
| 8,896,227 | B2 * | 11/2014 | Moskowitz et al. | 315/291 |
| 2008/0315778 | A1 | 12/2008 | Tatsukawa | |
| 2009/0230883 | A1 | 9/2009 | Haug | |
| 2010/0013172 | A1 | 1/2010 | Goertzen et al. | |
| 2010/0194298 | A1 | 8/2010 | Kuwabara | |
| 2010/0231135 | A1 | 9/2010 | Hum et al. | |
| 2010/0308739 | A1 | 12/2010 | Shteynberg | |

FOREIGN PATENT DOCUMENTS

| | | | |
|---|---|---|---|
| WO | 2007093938 | A1 | 8/2008 |
| WO | 2010027254 | A1 | 3/2010 |
| WO | 2012131602 | A1 | 10/2012 |

* cited by examiner

*Primary Examiner* — Jimmy Vu
(74) *Attorney, Agent, or Firm* — Yuliya Mathis

(57) ABSTRACT

A series arrangement of LED loads (LP1-LP4) is coupled between output terminals of a rectifier having its input terminals coupled to a mains supply supplying a low frequency AC voltage. Control means render the LED loads conductive one by one, when the amplitude of the supply voltage increases, and non-conductive one by one when the amplitude of the supply voltage decreases. The first LED load (LP1, LP2) has a forward voltage that is substantially higher than that of the other LED loads. As a consequence, the LED utilization is comparatively high, thus allowing the LED loads used in the series arrangement to be comparatively cheap.

14 Claims, 3 Drawing Sheets

| | 220V 311V | 110V 155V |
|---|---|---|
| 35V | 11.2% | 22.5% |
| 70V | 22.5% | 45.0% |
| 105V | 33.7% | 67.5% |
| 140V | 45.0% | 90.0% |
| 175V | 56.2% | |
| 210V | 67.5% | |
| 245V | 78.7% | |
| 280V | 90.0% | |

| | 220V 311V | 110V 155V |
|---|---|---|
| 36V | 11.6% | 23.1% |
| 72V | 23.1% | 46.3% |
| 108V | 34.7% | 69.4% |
| 144V | 46.3% | 92.6% |
| 180V | 57.9% | |
| 216V | 69.4% | |
| 252V | 81.0% | |
| 288V | 92.6% | |

| | 220V 311V | 110V 155V |
|---|---|---|
| 37V | 11.9% | 23.8% |
| 74V | 23.8% | 47.6% |
| 111V | 35.7% | 71.4% |
| 148V | 47.6% | 95.1% |
| 185V | 59.5% | |
| 222V | 71.4% | |
| 259V | 83.2% | |
| 296V | 95.1% | |

| | 220V 311V | 110V 155V |
|---|---|---|
| 27V | 8.7% | 17.4% |
| 54V | 17.4% | 34.7% |
| 81V | 26.0% | 52.1% |
| 108V | 34.7% | 69.4% |
| 135V | 43.4% | 86.8% |
| 162V | 52.1% | |
| 189V | 60.7% | |
| 216V | 69.4% | |
| 243V | 78.1% | |
| 270V | 86.8% | |

| | 220V 311V | 110V 155V |
|---|---|---|
| 28V | 9.0% | 18.0% |
| 56V | 18.0% | 36.0% |
| 84V | 27.0% | 54.0% |
| 112V | 36.0% | 72.0% |
| 140V | 45.0% | 90.0% |
| 168V | 54.0% | |
| 196V | 63.0% | |
| 224V | 72.0% | |
| 252V | 81.0% | |
| 280V | 90.0% | |

| | 220V 311V | 110V 155V |
|---|---|---|
| 29V | 9.3% | 18.6% |
| 58V | 18.6% | 37.3% |
| 87V | 28.0% | 55.9% |
| 116V | 37.3% | 74.6% |
| 145V | 46.6% | 93.2% |
| 174V | 55.9% | |
| 203V | 65.2% | |
| 232V | 74.6% | |
| 261V | 83.9% | |
| 290V | 93.3% | |

FIG. 5

LED LIGHT SOURCE

CROSS-REFERENCE TO PRIOR APPLICATIONS

This application is the U.S. National Phase application under 35 U.S.C. §371 of International Application No. PCT/IB2012/051312, filed on Mar. 19, 2012, which claims the benefit of and priority to European Patent Application No. 11160666.1, filed on Mar. 31, 2011. These applications are hereby incorporated by reference herein.

FIELD OF THE INVENTION

The invention relates to a LED light source comprising N LED loads that is directly connectable to a supply source supplying a low frequency AC voltage, such as the mains supply.

BACKGROUND OF THE INVENTION

Such a LED light source is known from U.S. Pat. No. 7,081,722. The LED loads are LED arrays comprising series arrangements and possibly parallel arrangements of individual LEDs. The known LED light source comprises a rectifier for rectifying the low frequency AC supply voltage. A series arrangement comprising the N LED loads is connected to output terminals of the rectifier. During operation, a periodicDC voltage with a frequency 2*f* and an amplitude varying between zero Volt and a maximum amplitude is present between the output terminals of the rectifier. When the amplitude of the periodicDC voltage is zero Volt, none of the LED loads carries current. When the amplitude of the periodicDC voltage increases, a voltage is reached at which a first LED load starts carrying current. Similarly, when the amplitude of the periodicDC voltage increases further to a high enough value, a second LED load starts conducting.

A further increase of the amplitude of the periodicDC voltage subsequently causes the remaining LED loads to start carrying current.

When all the LED loads carry current, the amplitude of the periodicDC voltage increases further until the maximum amplitude is reached. After that the amplitude of the periodicDC voltage starts decreasing. While the amplitude decreases, the LED loads stop conducting current one by one in reversed order (first the Nth LED load stops conducting and the first LED load is the last to stop conducting). After the first LED load has stopped conducting, the amplitude of the periodicDC current decreases further to zero and then the cycle described hereinabove is repeated.

The known LED light source is very compact and comparatively simple. Furthermore, it can be directly supplied from a low frequency AC supply voltage source such as the European or North American mains supply. LED-utilization is defined a follows:

LED_Utilization (in case N=4)=(I_LED1_AVG/I_LED1_AVG*Vseg1+I_LED2_AVG/I_LED1_AVG*Vseg2+I_LED3_AVG/I_LED1_AVG*Vseg3+I_LED4_AVG/I_LED1_AVG*Vseg4)/Vstring_total wherein I_LED#_AVG is the average current through the LED load, evaluated over one period of the low frequency AC supply voltage, Vseg# is the LED load voltage, Vstring_total is the total voltage of all 4 LED loads.

The low LED utilization is caused by the fact that the different LED loads conduct current during time intervals of substantially different duration within a period of the periodicDC voltage. The Nth LED load carries current during a much shorter time interval than the first LED load. As a consequence, the first LED load carries a higher average current than the Nth LED load. The LED loads are generally formed by one or more LED packages comprising a number of multi-junction LED dies. In the manufacturing process, the packages that will be used in the first LED load are not discriminated from the packages that will be used in any of the other LED loads; therefore, all the packages have the same die size and package power capacity that has to meet worst case requirements. In this case, said requirements correspond to the use of the package in a first LED load (which, during operation, carries the highest average current of all the LED loads). However, most of the LED packages used in the LED light source are not used in the first LED load.

SUMMARY OF THE INVENTION

It is an object of the invention to provide a LED light source, and a corresponding method, having a comparatively high LED utilization.

According to an aspect of the present invention, a LED light source is provided comprising

- a first input terminal and a second input terminal for connection to a supply voltage source supplying a low frequency AC supply voltage with frequency f,
- a rectifier coupled to the input terminals for rectifying the low frequency AC supply voltage,
- a series arrangement comprising N LED loads, a first end and a second end of said series arrangement being coupled to, respectively, a first output terminal and a second output terminal of the rectifier,
- control means for subsequently making the LED loads carry current one by one, starting with a first LED load that is closest to the first end, in dependence on the momentary amplitude of the low frequency AC supply voltage when the amplitude increases, and for subsequently making the LED loads stop carrying a current one by one, starting with the Nth LED load, in dependence on the momentary amplitude of the low frequency AC supply voltage when the amplitude decreases, wherein the forward voltage of the first LED load is at least 50% higher than the forward voltage of any of the other LED loads.

In the prior art, the forward voltage of all the LED loads is normally chosen to be approximately the same. In the case that the forward voltage of the first LED load is chosen to be 50% higher than that of the other LED loads, the first LED load will only start conducting at a comparatively high amplitude of the low frequency AC supply voltage and the average current through the first LED load will decrease because the time period during which the first LED load conducts current decreases. In the case that the combined forward voltage of all the LED loads remains the same, this decrease in average current through the first LED load generally leads to an increased utilization of the LEDs (see formula page 4).

In other words, because the first LED load carries a lower average current, the worst case to which the LEDs used in the LED light source might be exposed is less severe, so that the die size and the power capacity of the LED packages can be decreased and hence the LED packages are cheaper. It is noted that in order to obtain the same light output, the current through the LED loads needs to be somewhat higher than in the case of a prior art LED light source wherein the forward voltage of the first LED load is lower while the sum of the forward voltages of the LED loads is about the same. However, this increase in current is compensated for by the fact that the LED light source is substantially cheaper.

Preferably, the forward voltage of the first LED load is at least 100% higher than that of any of the other LED loads. In this latter case the average current through the first LED load is even smaller, so that the LED utilization is increased even more. Moreover, the forward voltage of the first LED load becomes so high that the total number of LED loads comprised in the LED light source can be reduced by 1, with respect to a prior art LED light source wherein the forward voltage of the first LED load is approximately equal to that of each of the other LED loads. This reduction of the number of LED loads means that for instance the number of switchable current sources needed in the LED light source is decreased by one, so that in addition to the higher LED utilization there is also cost saving because fewer components are needed.

Several implementations of the control means are possible. In a first example, the control means comprise

- N−1 control strings comprising a switch and shunting the second to the Nth LED load respectively,
- a control circuit coupled to the N−1 control strings for controlling the switches comprised in the control strings, and
- a current source couped between the Nth LED load and the second output terminal of the rectifier. This first implementation is comparatively simple to implement.

In a second example, the control means comprise N control strings comprising a switchable current source and connecting the cathode of a LED load to the second output terminal of the rectifier. During a time period wherein the first n LED loads are conducting current, only the nth current source is switched on and conducts current. Each of the switchable current sources first of all prevents the current through the LED loads from becoming too high. Furthermore, the current level of each of the switchable current sources can be adjusted to a different value. In the case that for instance different LED loads comprise LEDs of different colour, the colour of the light generated by all the current conducting LED loads together is changed every time a new LED load starts conducting. The contribution of each of these different colours to the average colour of the light perceived by the human eye can be adjusted by adjusting the current level of the switchable current sources. Adjusting the current level of the switchable current sources can also be used to reduce flicker and the stroboscopic effect of the light source, or it can be used to increase the power factor and reduce the input-current harmonic distortion.

In a preferred embodiment of a light source according to the invention, the LED light source comprises between 3 and 6 LED loads. Generally, when the number of LED loads increases, the ratio between power in the LED loads and the input power of the LED light source increases. However, the amount of circuitry comprised in the control means increases as well, so that the actual number of LED loads is a trade-off between efficiency and cost. The preferred embodiment offers good efficiency and reduced complexity of the control circuit.

In a preferred embodiment, the forward voltages of the second LED load to the Nth LED load are chosen to be identical. In this respect, it is remarked that in practice minor differences between these forward voltages may occur because of the spread in forward voltages occurring when the LED packages making up the LED loads are produced. These differences in practice often do not exceed +5% or −5%.

In many practical applications, the number of LED loads is chosen in the range between 3 and 5. A first example is a LED light source according to the invention, wherein the LED light source comprises a first, a second and a third LED load, of which the ratio between the forward voltages is 2:1:1. A second example is a LED light source according to the invention, wherein the LED light source comprises a first, a second and a third LED load, of which the ratio between the forward voltages is 5:2:1. A third example is a LED light source, wherein the LED light source comprises a first, a second, a third and a fourth LED load, of which the ratio between the forward voltages is 3:1:1:1. Again, minor deviations from these ratios may in practice occur because of the spread in forward voltages occurring when the LED packages making up the LED loads are produced.

Preferably, the LED loads are formed by one or more LED packages comprising one or more multi-junction LED dies. Use of the packages renders the manufacturing of a LED light source according to the invention comparatively easy. The LED packages preferably have a forward voltage in one of the ranges in the group formed by 24V±5%, 36V±5%, 48V±5% and 72V±5%. The ranges are chosen so that when the low frequency AC supply voltage is the European mains voltage or the North American mains voltage, the LED loads can easily be formed by a number of these packages.

Good results have been obtained for light sources wherein the forward voltage of the first LED load is between 26% and 60% of the maximum amplitude of the low frequency AC supply voltage, preferably between 33% and 48% of the maximum amplitude of the low frequency AC supply voltage, and more preferably between 40% and 48% of the maximum amplitude of the low frequency AC supply voltage.

In another preferred embodiment of a light source according to the invention, the LED light source further comprises

- a series arrangement of a capacitive element and a switch S,
- a second control circuit coupled to the switch S for rendering the switch conductive and non-conductive in dependence on the momentary amplitude of the low frequency AC supply voltage.

The switch S is controlled so that the capacitive element is charged during a time period wherein the momentary amplitude of the periodicDC voltage is comparatively high. The voltage across the capacitive element is used as a supply voltage for the LED loads when the momentary amplitude of the periodicDC voltage is comparatively low. In this way, the total amount of current supplied to the LED loads is increased.

According to another aspect of the present invention, a method of supplying a series arrangement of N LED loads is provided, comprising the following steps

- providing a low frequency AC supply voltage,
- rectifying the low frequency AC supply voltage,
- supplying the rectified AC supply voltage to the series arrangement comprising N LED loads,
- subsequently making the LED loads carry current one by one, starting with a first LED load that is closest to a first end of the series arrangement, in dependence on the momentary amplitude of the low frequency AC supply voltage, when the amplitude increases,
- subsequently making the LED loads stop carrying current one by one, starting with the Nth LED load, in dependence on the momentary amplitude of the low frequency AC supply voltage, when the amplitude decreases, wherein the forward voltage of the first LED load is at least 50% higher than the forward voltage of any of the other LED loads.

BRIEF DESCRIPTION OF THE DRAWINGS

Embodiments of a LED light source according to the invention will be further described with reference to a drawing.

In the drawing, FIG. 5 shows a table illustrating how the LED loads in different embodiments of a LED light source according to the invention can be composed of LED packages with different forward voltages.

DETAILED DESCRIPTION OF PREFERRED EMBODIMENTS

Figure 1A:
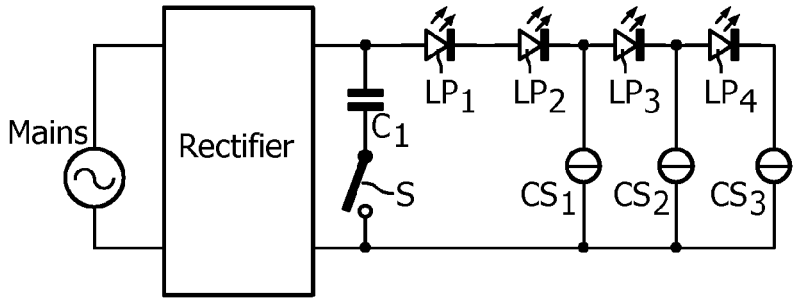
FIGS. 1-4 show schematic representations of embodiments of a LED light source according to the invention.

In FIG. 1*a*, MAINS is a mains voltage source supplying a low frequency AC supply voltage. The mains voltage source is connected to input terminals of a rectifier. Output terminals of the rectifier are connected by means of a series arrangement of a capacitive element C1 and a switch S, and by means of a series arrangement of a first LED load formed by LED package LP1 and LED package LP2, a second LED load formed by LED package LP3, a third LED load formed by LED package LP4 and a control string formed by switchable current source CS3. A second control string is formed by switchable current source CS2 and connects a cathode of the second LED load to the second output terminal of the rectifier. A third control string is formed by switchable current source CS1 and connects a cathode of the first LED load to the second output terminal of the rectifier. The LED packages LP1-LP4 are identical. The switch S and also the switchable current sources are coupled to control circuitry (not shown). During operation, a rectified mains voltage is present between the output terminals of the rectifier. In the case that the amplitude of the rectified mains voltage increases, the first to third LED load subsequently start carrying current one by one, starting with the first LED load and in dependence on the amplitude of the rectified mains voltage. In the case that the amplitude of the rectified mains current decreases, the LED loads subsequently stop carrying current one by one, starting with the third LED load and in dependence on the amplitude of the rectified mains current. At any one moment, only one of the current sources CS1-CS3 carries current. Since the LED packages are identical, the forward voltage of the first LED load is twice as high as the forward voltages of the second and the third LED load. Since the forward voltage of the first LED load is comparatively high, it only starts conducting when the amplitude of the rectified mains voltage is comparatively high. The average current through the first LED load is therefore comparatively small, so that the LED utilization is comparatively high. As a consequence, the LED packages have to meet less severe requirements than in the case of a higher average current through the first LED load and can therefore be less expensive.

It is remarked that in the case that the cathode of LED package LP1 was also connected to the second output terminal of the rectifier by means of a switchable current source, a LED light source would result wherein there would be four LED loads with identical forward voltages. In this situation, the first LED load formed by LP1 would start conducting and later stop conducting at a much lower amplitude of the rectified mains voltage. As a consequence, the average current through the first LED load would be comparatively high.

Figure 1B:
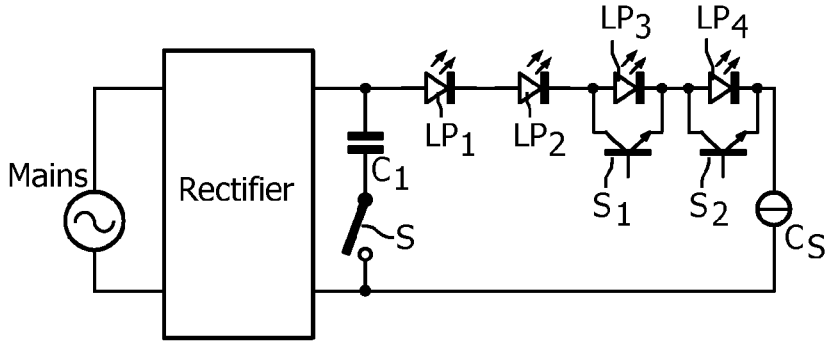
Figure 2:
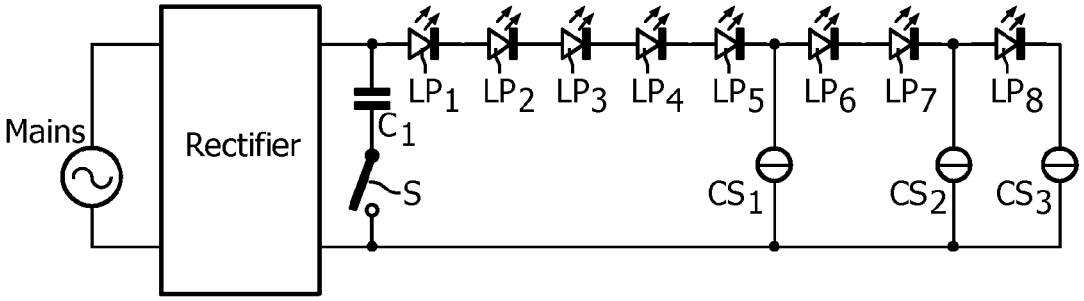
Figure 3:
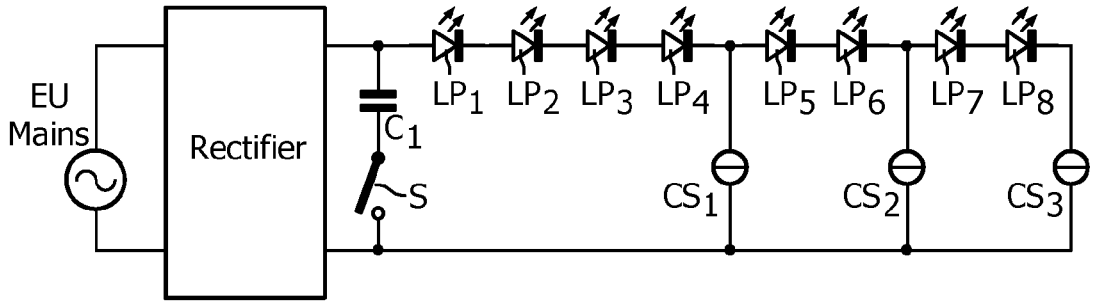
Figure 4:
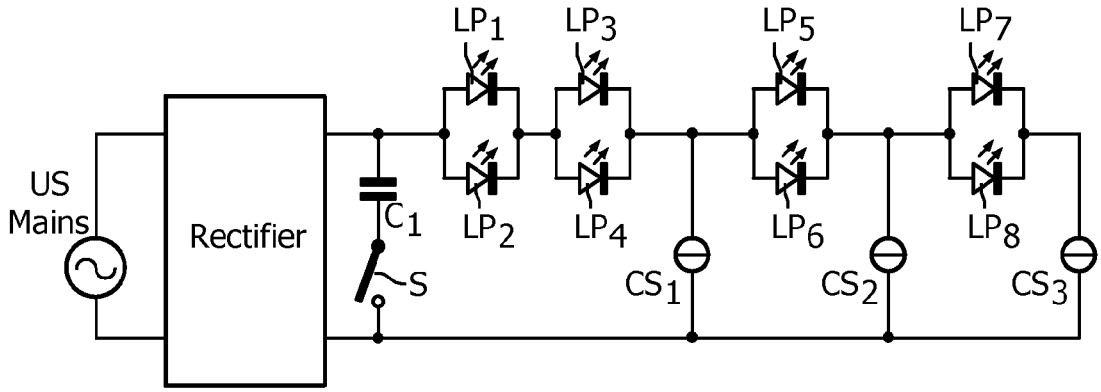

In FIG. 1*b* and in FIG. 2-FIG. 4, circuit parts and components similar to circuit parts and components in the embodiment shown in FIG. 1 are labeled with the same references.

The differences between FIG. 1*a* and FIG. 1*b* are that the two control strings containing current source CS1 and current source CS2 respectively are dispensed with. Instead, the second LED load is shunted by a control string comprising a switch S1 and the third LED load is shunted by a control string comprising a switch S2. The switch S and also the switches S1 and S2 are coupled to control circuitry (not shown). FIG. 1*a* and FIG. 1*b* thus only differ in respect of the control means. During operation, when the amplitude of the periodic DC voltage increases, switches S1 and S2 are conductive at first so that only the first LED load carries current. When the amplitude of the periodic DC voltage increases further, switch S1 and switch S2 are subsequently rendered non-conductive so that the first two LED loads and all three LED loads respectively carry current. When the amplitude of the periodicDC voltage starts to decrease, first switch S2 and later switch S1 are rendered conductive again, so that the third LED load and subsequently the second LED load stop carrying current. Upon a further decrease of the amplitude of the periodicDC voltage, also the first LED load stops carrying current. Also in the case of the LED light source shown in FIG. 1*b*, the first LED load has a comparatively high forward voltage, so that the average current through the first LED load is comparatively low and the LED packages have to meet less severe requirements than in the case of a higher average current through the first LED load and can therefore be less expensive.

In FIG. 2, LP1-LP8 are LED packages. They are mutually identical but have a different forward voltage than the LED packages used in the embodiment shown in FIG. 1. The difference between the embodiment shown in FIG. 1 and the one shown in FIG. 2 is that in the latter the first LED load comprises 5 LED packages instead of two and the second LED load comprises 2 LED packages instead of one. The operation of the embodiment shown in FIG. 2 is similar to that in FIG. 1. Since the forward voltage of the first LED load is comparatively high (more than 100% higher than that of any other LED load), the LED utilization is comparatively high.

In FIG. 3 and FIG. 4, a LED light source for connection to a European mains supply and a LED light source for connection to a North American mains supply are shown respectively. In each of the embodiments shown in FIG. 3 and FIG. 4, the first LED load comprises four LED packages, the second LED load comprises two LED packages and the third LED load comprises two LED packages. However, in the LED loads of the embodiment shown in FIG. 3 the LED packages are mounted in series, while in the LED loads in the embodiment shown in FIG. 4 they are mounted in groups of two parallel LED packages. As a consequence, the forward voltage of each LED load in the embodiment in FIG. 3 is twice as high as that of the corresponding LED load in the embodiment of FIG. 4. The LED loads are thus matched with the amplitude of the European mains and the North American mains respectively. The operation of the embodiments disclosed in FIG. 3 and FIG. 4 is similar to that of the embodiment shown in FIG. 1.

In the embodiment shown in FIG. 3 as well as in the embodiment shown in FIG. 4, the forward voltage of the first LED load is twice as high as the forward voltage of the second LED load and the third LED load. Again, for the same reasons as in embodiment 1, this causes the LED utilization to be comparatively high and the cost of the LED packages to be comparatively low.

In each of the embodiments shown in FIG. 1 to FIG. 4, the switch S is operated so that the capacitive element C1 is charged when the rectified mains voltage has a comparatively high momentary amplitude. When the momentary amplitude of the rectified mains is comparatively low, the capacitive element functions as a supply voltage source for supplying the LED loads.

The table shown in FIG. 5 illustrates how the LED loads in LED light sources according to the invention can be formed out of LED packages with a certain forward voltage as a standard building block.

Six examples are given, each relating to LED packages with a different forward voltage. The first three columns in the left top corner of the table illustrate how the different LED loads of LED light sources for use with respectively 220 V mains and 110 V mains are composed making use of LED packages with a forward voltage of 35 Volt. In the first and second row of the second column the rms value of 220 Volt and the maximum amplitude of 311 Volt of the 220V mains voltage are listed. Similarly, for the 110V mains a rms value of 110 Volt and a maximum amplitude of 155 Volt are listed in the first and second row respectively of the third column. The third line in column 1 mentions the forward voltage of one LED package. The fourth line mentions the forward voltage of two LED packages in series, the fifth line mentions the forward voltage of three LED packages in series and so on. The third line in the second column expresses the forward voltage of one LED package as a percentage of the amplitude of the European mains supply. The fourth line in the second column expresses the forward voltage of two LED packages in series as a percentage of the amplitude (311 V) of the 220V mains supply and so on. Similarly, the third line in the third column expresses the forward voltage of one LED package as a percentage of the amplitude (155 V) of the 110 V mains supply. The fourth line in the third column expresses the forward voltage of two LED packages in series as a percentage of the amplitude of the 110 V mains supply and so on.

It can be seen that in the LED light source intended for use with the 220 V mains supply, 8 LED packages are used. The distribution of these LED packages over the different LED loads is indicated by means of horizontal lines. It can be seen that the first LED load comprises 4 LED packages in series, and the second and third LED load each consist of two LED packages in series. The forward voltage of the first LED load is 45% of the amplitude of the mains supply, the forward voltage of the first two LED loads is 67.5% of the amplitude of the mains supply and the forward voltage of the first three LED loads is 90% of the amplitude of the mains supply.

Similarly, in the LED light soure meant for the 110V mains supply, 4 LED packages with a forward voltage of 35 Volt are used. Also in this case the distribution of these LED packages over the different LED loads is indicated by means of horizontal lines.

The first LED load comprises 2 LED packages in series, and the second and third LED load each consist of 1 LED package. Also in this case, the forward voltage of the first LED load is 45% of the amplitude of the mains supply, the forward voltage of the first two LED loads is 67.5% of the amplitude of the mains supply and the forward voltage of the first three LED loads is 90% of the amplitude of the mains supply.

In a similar way, the next three columns in the top half of the table show how the different LED loads can be composed of LED packages with a forward voltage of 36 Volt both for the 220 V and the 110 V mains supply respectively. Also in this case there are three LED loads. The last three columns in the upper half of the table illustrate the use of LED packages with a forward voltage of 37 Volt to form the LED loads in a LED light source according to the invention for 220V and 110V mains respectively. Also in this case there are three LED loads.

In the following three examples given in the lower half of the table, the use of LED packages with a forward voltage of respectively 27 Volt, 28 Volt and 29 Volt are presented. In these last three examples the number of LED loads is four, the number of LED packages in the first LED load is four, and in each of the other three LED loads the number of LED packages is two.

The invention claimed is:

1. A LED light source comprising a first input terminal and a second input terminal for connection to a supply voltage source supplying a low frequency AC supply voltage with frequency f, a rectifier coupled to the input terminals for rectifying the low frequency AC supply voltage, a series arrangement comprising N LED loads, a first end and a second end of said series arrangement being coupled to, respectively, a first output terminal and a second output terminal of the rectifier, control means for subsequently making the LED loads carry current one by one, starting with a first LED load that is closest to the first end, in dependence on the momentary amplitude of the low frequency AC supply voltage when the amplitude increases and for subsequently making the LED loads stop carrying current one by one, starting with the Nth LED load, in dependence on the momentary amplitude of the low frequency AC supply voltage when the amplitude decreases, wherein forward voltage of the first LED load is at least 50% higher than forward voltage of any of the other LED loads.

2. The LED light source according to claim 1, wherein the forward voltage of the first LED load is at least 100% higher than that of any of the other LED loads.

3. The LED light source according to claim 1, wherein the control means comprise N−1 control strings comprising a switch and shunting the second to the Nth LED load respectively, a control circuit coupled to the N−1 control strings for controlling the switches comprised in the control strings, and a current source coupled between the Nth LED load and the second output terminal of the rectifier.

4. The LED light source according to claim 1, wherein the control means comprise N control strings comprising a switchable current source and connecting the cathode of a LED load to the second output terminal of the rectifier.

5. The LED light source according to claim 1, wherein the LED light source comprises between 3 and 6 LED loads.

6. The LED light source according to claim 1, wherein the forward voltages of the second LED load to the Nth LED load are chosen to be identical.

7. The LED light source according to claim 1, comprising a first, a second and a third LED load, of which the ratio between the forward voltages is 2:1:1.

8. The LED light source according to claim 1, comprising a first, a second and a third LED load, of which the ratio between the forward voltages is 5:2:1.

9. The LED light source according to claim 1, comprising a first, a second, a third and a fourth LED load, of which the ratio between the forward voltages is 3:1:1:1.

10. The LED light source according to claim 1, wherein the LED loads are formed by one or more LED packages comprising one or more multi-junction LED dies.

11. The LED light source according to claim 10, wherein the LED packages have a forward voltage in one of the ranges selected from the group consisting of 24V±5%, 36V±5%, 48V±5% and 72V±5%.

12. The LED light source according to claim 10, wherein the forward voltage of the first LED load is between 26% and 60% of the maximum amplitude of the low frequency AC supply voltage, preferably between 33% and 48% of the maximum amplitude of the low frequency AC supply voltage, and more preferably between 40% and 48% of the maximum amplitude of the low frequency AC supply voltage.

13. The LED light source according to claim 1, wherein the LED light source further comprises a series arrangement of a capacitive element and a switch S, a second control circuit coupled to the switch S for rendering the switch conductive and non-conductive in dependence on the momentary amplitude of the low frequency AC supply voltage.

14. A method of supplying a series arrangement of N LED loads, comprising the following steps providing a low frequency AC supply voltage, rectifying the low frequency AC supply voltage, supplying the rectified AC supply voltage to the series arrangement comprising N LED loads, subsequently making the LED loads carry current one by one, starting with a first LED load that is closest to a first end of the series arrangement, in dependence on the momentary amplitude of the low frequency AC supply voltage, when the amplitude increases, subsequently making the LED loads stop carrying current one by one, starting with the Nth LED load, in dependence on the momentary amplitude of the low frequency AC supply voltage, when the amplitude decreases, wherein forward voltage of the first LED load is at least 50% higher than forward voltage of any of the other LED loads.

* * * * *